US006092655A

United States Patent [19]

Ernst

[11] Patent Number: 6,092,655

[45] Date of Patent: Jul. 25, 2000

[54] WRENCH SOCKET HOLDER

[76] Inventor: Gregory R. Ernst, 15735 SE. Bartell Rd., Boring, Oreg. 97009

[21] Appl. No.: 09/309,392

[22] Filed: May 10, 1999

[51] Int. Cl.[7] ..... B65D 85/28

[52] U.S. Cl. ..... 206/378; 211/70.6

[58] Field of Search ..... 206/349, 372–379, 206/493; 211/70.6; 81/124.2, 124.6, 124.7

[56] References Cited

U.S. PATENT DOCUMENTS

| | | | |
|---|---|---|---|
| 1,712,473 | 5/1929 | McWethy . | |
| 3,726,393 | 4/1973 | Thompson . | |
| 4,043,453 | 8/1977 | Greenlee . | |
| 4,421,230 | 12/1983 | Stanton . | |
| 4,717,106 | 1/1988 | Bies et al. | 211/70.6 |
| 4,927,020 | 5/1990 | Randy . | |
| 4,987,998 | 1/1991 | Tsai . | |
| 5,154,544 | 10/1992 | Arendt . | |
| 5,313,181 | 5/1994 | Negus . | |
| 5,343,181 | 8/1994 | Negus . | |
| 5,398,823 | 3/1995 | Anders . | |
| 5,500,631 | 3/1996 | Negus . | |
| 5,715,951 | 2/1998 | Dembicks | 206/378 |
| 5,740,911 | 4/1998 | Chou | 206/378 |
| 5,862,913 | 1/1999 | Chou | 206/378 |

*Primary Examiner*—Paul T. Sewell
*Assistant Examiner*—Luan K. Bui
*Attorney, Agent, or Firm*—James D. Givnan, Jr.

[57] ABSTRACT

A wrench socket holder includes a post structure on which may be received a wrench socket. A flexible arm adjacent the post carries a boss which seats in a recess commonly found in internal socket walls and otherwise utilized for drive stud retention. A resilient member extends intermediate the post and arm to urge the latter toward engagement with a socket thereon to insure retention of the socket against all but intentional removal. A base of the socket holder may be shaped for sliding engagement with an elongate guideway or an elongate surface for the reception of several socket holders. A modified form of socket holder dispenses with a resilient member and relies on resiliency of the arm for socket retention. A multitude of socket holders may be supported by a common base on which several semicircular socket receptacles are formed with the holders preventing undesired socket separation from the holder.

7 Claims, 2 Drawing Sheets

FIG. 2
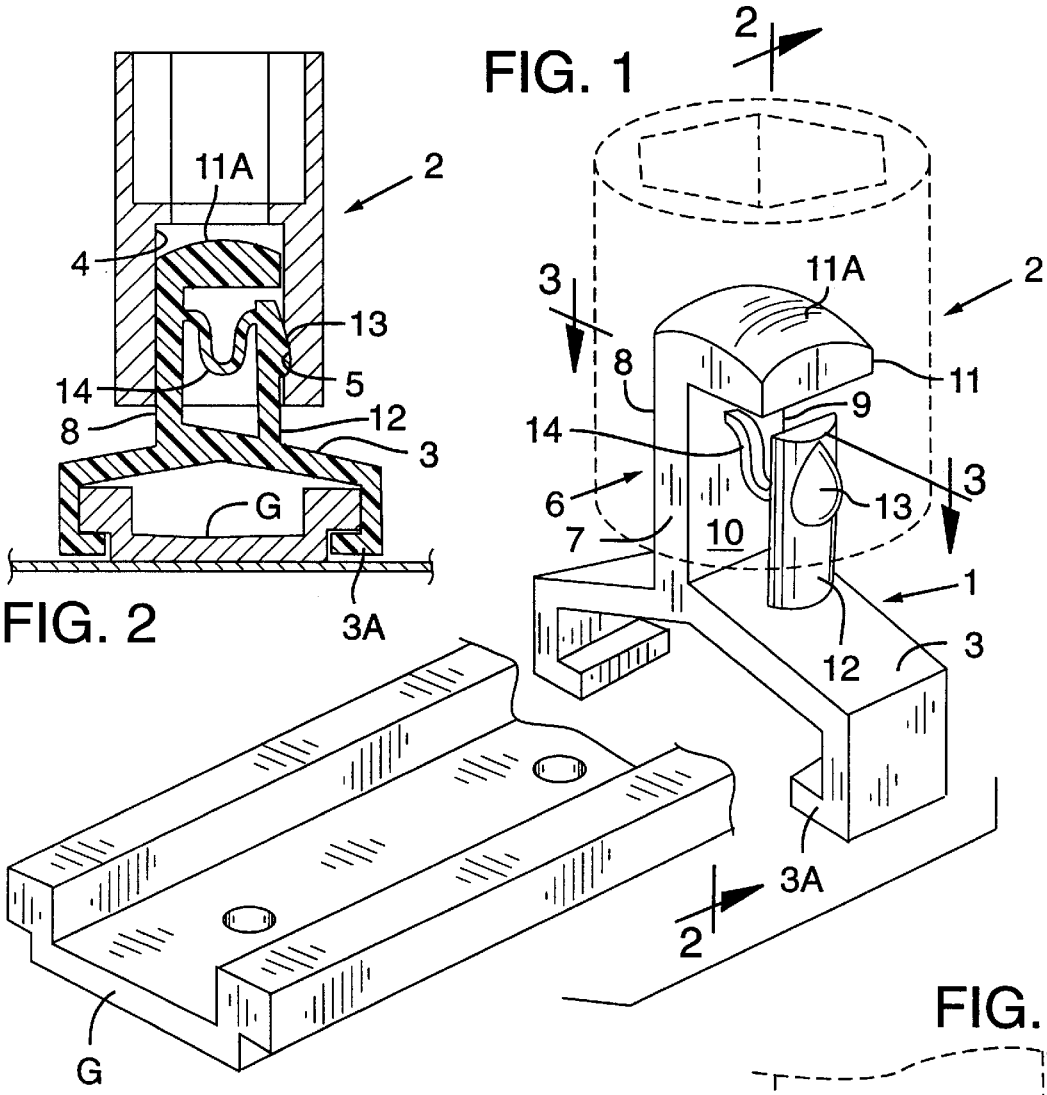
FIG. 1
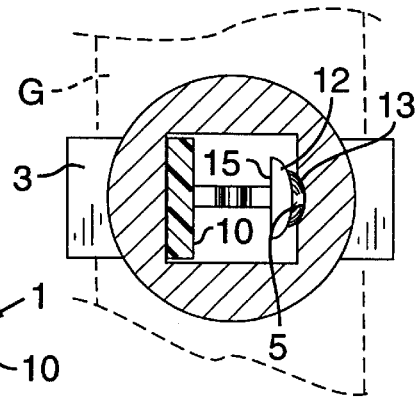
FIG. 3
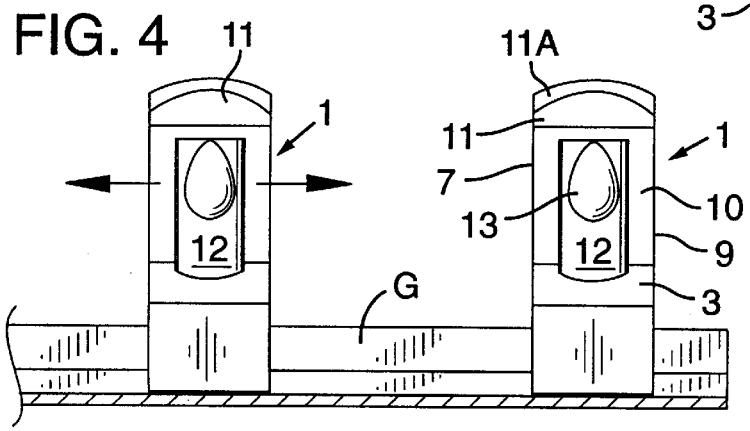
FIG. 4

WRENCH SOCKET HOLDER

BACKGROUND OF THE INVENTION

The present invention is embodied within a holder on which may be supported a socket of the type coupled to a wrench for imparting torque to a nut.

Socket wrenches are usually sold and used with an array of sockets for engagement with a range of nut sizes. The sockets may be stored in tool boxes or tool chests along with the socket wrench which commonly is of the ratchet type. To facilitate selection of the correct socket for the task at hand it is highly desirable that the sockets be kept in orderly fashion in the tool box or chest. Provisions for the orderly storage of wrench sockets include various types of holders. The prior art includes holders having multiple studs each similar to the drive stud of a socket wrench mounted on a base to receive a socket. While such a provision for socket retention may retain the wrench socket in place such a holder is of costly manufacture as ordinarily a coil spring biased ball element is utilized to seat within a recess of the socket. As a tool set, including a socket wrench and several sockets are costly, the provision of the foregoing described socket holder renders the tool set even more costly.

U.S. Pat. No. 1,712,473 discloses several socket holders in place on a base with each holder having a pair of ball elements biased by a spring therebetween for seated engagement with a recessed inner wall surface of a wrench socket.

U.S. Pat. No. 3,726,393 discloses a socket holder each having multiple retainers graduating in size to accept sockets intended for use with socket wrenches having different sized drive studs. The socket is retained in place by gravity. Sheets provided with several such retainers may be adhesively attached or magnetically held in place within a tool box drawer.

U.S. Pat. No. 4,043,453 discloses a display rack including a socket fastening device for socket retention on a display rack with a theft avoidance feature. The fastening device includes a pair of parallel legs having a resilient arm therebetween with an outwardly projecting catch on the arm. For theft prevention the catch must be forced out of a detent opening in the socket requiring the purchaser or sales person to insert an elongate implement through the socket drive recess to pry the catch carrying arm inwardly for catch removal from the opening. While the fastening device is apparently suitable for displayed tools, such socket retention would be highly impractical for a workman who frequently must change socket sizes on a job.

U.S. Pat. No. 4,927,020 shows a dovetailed grooved base which slidably receives a multitude of square posts or studs in an adjustable manner with the posts each serving to store wrench sockets thereon.

U.S. Pat. No. 4,987,998 discloses a device for storing sockets and wrenches with a multitude of clips provided with each having a head of a resilient nature shaped and sized to engage the drive recess of a socket in a frictional manner.

U.S. Pat. No. 5,154,544 discloses a base having rows of cylindrical posts each sized to accept wrench sockets having different sized drive openings. The device is of molded construction with the socket receiving posts sized to provide a "slip fit" with the drive opening of each socket.

U.S. Pat. Nos. 5,313,181; 5,343,181 and 5,550,631 issued to the same inventor disclose a holder for two different lengths of sockets with provision made for retention of the wrench sockets in place by magnetic force.

U.S. Pat. No. 5,398,823 discloses a socket holder essentially of molded construction which may be shaped for retention of a ball element biased by a coil spring to seat in a socket recess.

SUMMARY OF THE PRESENT INVENTION

The present invention is embodied within a holder on which a wrench socket may be supported to retain same in place against all but intentional manual effort.

The present holder includes a base structure which may take one of several forms to best suit the purposes at hand. A post of the present holder is configured to engage the drive wall surfaces of the socket otherwise occupied by the drive stud of a socket wrench during socket use. Post surfaces serve to guide the socket being installed on the holder downwardly past an arm of the holder having a boss thereon which seats in a recess typically provided in the socket wall. During such installation of the socket on the present holder and oppositely during removal of the socket from the holder, an arm of the holder flexez inwardly or toward the post enabling boss entry in the wall recess. A modified form of the holder includes a spring component which biases the arm to a desired static position and diminishes creep occurring in the molded arm structure which would otherwise diminish its socket retention. A holder base may be configured to best suit the end use of the holder, e.g., orderly storage of wrench sockets in a tool box or tool chest enabling convenient socket selection or shaped to slidably engage a guideway on which several holders are adjustably mounted.

Important objectives include the provision of a wrench socket holder which prevents undesired separation of the wrench socket from a holder yet requires only finger tip effort for such removal; the provision of a wrench socket holder which lends itself to economical low cost production methods while avoiding costly assembly efforts; the provision of a wrench socket holder including a spring component directed toward minimizing creep of the synthetic material used for molding of the holder to render the holder operable over a long period of time regardless of repeated flexing of a holder arm.

BRIEF DESCRIPTION OF THE DRAWINGS

In the drawings:

FIG. 1 is an unexploded perspective view of the present socket holder offset from a guide fragment for the holder;

FIG. 2 is a vertical sectional view taken along line 2—2 of FIG. 1;

FIG. 3 is a horizontal sectional view taken along line 3—3 of FIG. 1;

FIG. 4 is a front elevational view of socket holders in place on an elongate guide;

DETAILED DESCRIPTION OF THE PREFERRED EMBODIMENTS

Figure 5:
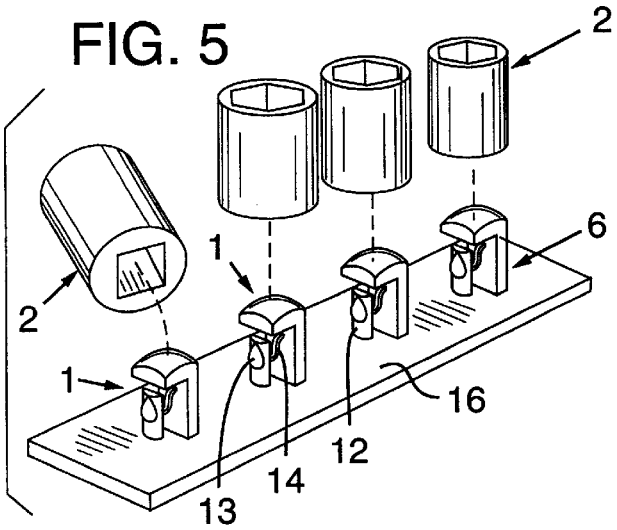
FIG. 5 is a perspective view of a series of socket holders in place as a common base.

With continuing attention to the drawings, the reference numeral 1 thereon indicates generally the present holder for wrench sockets of the type shown generally at 2.

A base 3 of the socket holder may be a configuration permitting slidable installation on an elongate guideway G capable of receiving multiple socket holders spaced appropriately to receive the cylindrical sockets. The wrench sockets 2 typically have internal walls as at 4 with one or more of the walls defining a recess 5 which, when the socket is in place on a socket wrench, receives a spring biased ball carried by the drive stud of the wrench. With attention again to base 3 of the holder, the base may include flanges 3A for retention of base in slidable engagement with elongate guideway G.

A post generally at 6 on base 3 is quadrilateral with wall surfaces 7, 8, 9 and 10 slidably receiving internal walls 4 of the socket. Post wall surfaces 7, 8, 9 and 10 terminate upwardly in a head 11 which preferably has a spherical surface 11A to aid in socket installation. Post wall surfaces 7, 8, 9 and 10 guide a socket 2 into place during which an arm 12 of the holder may flex inwardly toward post 6 to permit socket travel to the extent a boss 13 on arm 12 seats in socket wall recess 5 for socket retention. Boss 13 is convex and provides a tactile indication during socket installation that the socket has been properly seated on the holder.

A resilient member 14 in the preferred form of the holder is formed at the time of molding the holder and is integral with post wall surface 10 and an opposing or inner surface 15 of arm 12. Resilient member 14 serves to resist the tendency, termed creep in a plastic component, to lose their flexibility after repeated flexing.

In FIG. 5 the present holder is shown with several holders in place on a base 16 of planar shape which may be of a size and shape for placement in the drawer of a tool box or tool chest.

Figure 6:
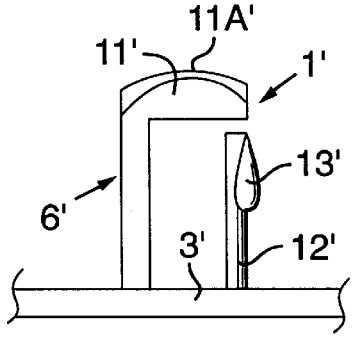
FIG. 6 is a side elevational view of a modified form of the present socket holder.

In FIG. 6 a modified form of socket holder indicated at 1' dispenses with the earlier described resilient member 14. Such a holder would be suitable for those uses where the resiliency of an arm 12' is less critical, e.g., on those socket holders used simply to display wrench sockets and not subjected to heavy use. Other holder parts are identified with prime reference numerals.

Figure 7:
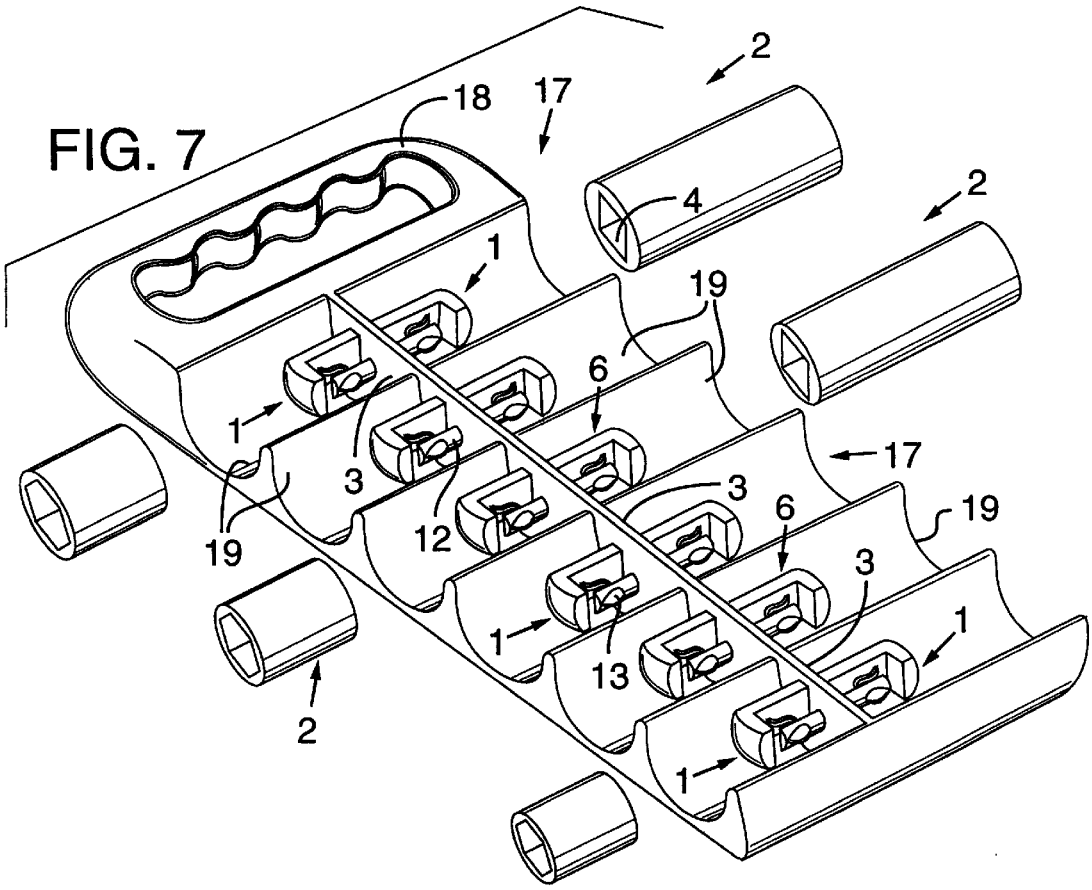
FIG. 7 is a perspective view of still another base with which the present socket holder may be utilized.

In FIG. 7 the present socket holder shown generally at 1 is part of a carrier generally at 17 and having a handle 18 and semi-circular socket receptacles 19. A base 3 carries oppositely mounted socket holders. The holders 1 restrain the wrench sockets from undesired separation from the carrier during travel of the carrier.

Resilient member 14 is shown as being of molded construction. It is to be understood that other embodiments of same may include a resilient member of other than the U-shape configuration shown at 14 to bias arm 12 toward socket engagement.

A suitable material for injection molding of the present holder is a plastic which permits arm 12 to flex while minimizing creep.

While a variety of base configurations are shown it will be understood that still other base configurations may be utilized without departing from the scope of the present invention.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A holder for a wrench socket having internal walls including, a base, a post on said base terminating in a head on which a wrench socket may be seated, an arm carried by said base and having a boss thereon for seating in a recess defined by one of the socket internal walls, said arm being of a flexible nature to permit boss displacement during installation and removal of a socket from the holder, and a resilient member biasing said boss away from said post and toward the recess in said one of said socket internal walls.

2. The holder claimed in claim 1 wherein said resilient member is of molded construction and integral with said post and said arm.

3. The holder claimed in claim 2 wherein said resilient member is of U-shape having ends integral with said post and said arm.

4. The holder claimed in claim 1 wherein said head includes a spherical surface to facilitate socket engagement with the holder.

5. A holder for retention of a wrench socket having internal walls defining an opening for wrench reception, one of said internal walls defining a recess, said holder including, a base, a post on said base including quadrilateral wall surfaces along which internal socket walls of a wrench socket can be slidably positioned, an arm including a boss, said boss for seating within the recess in one of the socket walls, said arm of flexible construction so as to flex during contact with a socket, and a resilient member integral with one of said post wall surfaces and with said arm and biasing arm in a direction away from said post for wrench socket contact.

6. The holder claimed in claim 5 wherein said resilient member is of molded, curvilinear construction.

7. The holder claimed in claim 5 wherein said wall surfaces terminate in a spherical crown facilitating socket placement on the holder.

* * * * *